US005147753A

United States Patent [19]

Hikake

[11] Patent Number: 5,147,753

[45] Date of Patent: Sep. 15, 1992

[54] PROCESS FOR PRODUCING TONER FOR DEVELOPING ELECTROSTATIC IMAGE

[75] Inventor: Norio Hikake, Yokohama, Japan

[73] Assignee: Canon Kabushiki Kaisha, Tokyo, Japan

[21] Appl. No.: 584,652

[22] Filed: Sep. 19, 1990

[30] Foreign Application Priority Data

Sep. 19, 1989 [JP] Japan ..... 1-240836

[51] Int. Cl.[5] ..... G03G 9/08

[52] U.S. Cl. ..... 430/137

[58] Field of Search ..... 430/137

[56] References Cited

U.S. PATENT DOCUMENTS 2,297,691 10/1942 Carlson ..... 430/31
4,430,413 2/1984 Westdale et al. ..... 430/137
4,782,001 11/1988 Kanda et al. ..... 430/137
4,784,333 11/1988 Hikake et al. ..... 241/5
4,802,977 2/1989 Kanda ..... 430/137
4,839,255 6/1989 Hyosu et al. ..... 430/137
4,844,349 7/1989 Kanda et al. ..... 241/19
4,900,647 2/1990 Hikake et al. ..... 430/137

FOREIGN PATENT DOCUMENTS 53-58244 5/1978 Japan .

*Primary Examiner*—Roland Martin
*Attorney, Agent, or Firm*—Fitzpatrick, Cella, Harper & Scinto

[57] ABSTRACT

A process for producing a toner for developing an electrostatic image, comprises;

a first classification step for classifying a colored resin powder containing at least a resin and a coloring agent to remove fine powder to give a classified powder having a given particle size;

a mixing step for mixing the classified powder thus obtained and a fine silica powder to give a mixed powder; and a second classification step for removing the fine powder from the mixed powder.

16 Claims, 5 Drawing Sheets

PROCESS FOR PRODUCING TONER FOR DEVELOPING ELECTROSTATIC IMAGE

BACKGROUND OF THE INVENTION

1. Field of the Invention

The present invention relates to a process for preparing a toner for developing an electrostatic image formed by a process such as electrophotography, electrostatic recording or electrostatic printing.

2. Related Background Art

As disclosed in U.S. Pat. No. 2,297,691, Japanese Patent Publications No. 42-23910 and No. 43-2478, there are large number of electrophotographic methods. In general, copies are obtained by forming an electrostatic latent image on a photosensitive made of photoconductive material. Then the latent image is developed by the use of a toner and the toner image is transferred to a transfer medium such as paper if desired, after which the toner image is fixed by the action of heat, pressure, heat-and-pressure, or solvent vapor.

Toners are required to have a sharp particle size distribution. In the process of producing a toner, coarse particles that may adversely affect image quality or fine particles that may cause fog are removed by providing classification steps.

In the classification process fine particles of not more than 2 to 3μ firmly adhere electrostatically to particles having the desired particle size and such particles are difficult to separate. These fine particles firmly adhere to the surface of each part of the developing unit and are fixed there, tending to cause ghosts or a deterioration of images and a lowering of density when copies are taken in a large number. As a means for solving such problems, Japanese Patent Application Laid-Open No. 53-58244 proposes a method in which a fine silica powder is added to a colored resin powder that serves as a toner, which are mixed and then classified into powder with a specific particle diameter, or, after classification, further heated to carry out a treatment for making the particles in the powder spherical.

The method disclosed in the above Japanese Patent Application Laid-Open No. 53-58244 employs a V-type mixer when silica powder is mixed with toner. The dispersion power of the V-type mixer is relatively weak, so that agglomerates tend to be present in a toner. Consequently, white dots tend to appear at a black solid area of a toner image, and fog or the like tends to appear in the non-image area. This method has an additional problem in that the amount of silica powder may change from the amount when added. This problem is due to the variability of mixing conditions, the types of classifiers employed as well as the classification conditions.

In general, toners are prepared by melt-kneading at least a resin and a coloring agent and other additives, followed by pulverization and classification to control the particle size of the resulting powder. In the course of the classification, powder is removed as coarse powder or fine powder in an amount of from 15 to 40% by weight based on the feed. The amount of powder removed depends on the quality required for toners or the performance of a classifier used. For economy, the coarse and fine powders which were removed are blended with starting materials at the time of melt-kneading.

In the above method proposed in Japanese Patent Application Laid-Open No. 53-58244, the powdery silica and additives which originally should not be included in toner particles, are mixed into the coarse powder or fine powder at the time of the classification. The resulting coarse and fine powders are difficult to recycle because the powders contain silica powder and additives.

When the powdery silica and additives are mixed with a pulverized product in the presence of a large quantity of the fine powder, the various substituents are not well dispersed. This is because the fluidity or agglomerating properties of the powdery silica are higher than those of a toner. As a result, removal of the fine powder during classification as well as the quality problems noted above can not be eliminated.

A conventional process for producing a toner will be further detailed with reference to the accompanying FIGS. 2 and 3.

FIGS. 2 and 3 show flow charts of the respective steps in conventional processes for producing toners.

The conventional process as shown in FIG. 2 can achieve a superior utilization efficiency of starting materials, but tends to result in an insufficient removal of fine powder (in particular, the one with a particle size of not larger than 2 to 3μ as described above). This process has a limit in the removal of the fine powder even if the amount of powder discharged to the fine powder side is increased at the time of classification. Hence, not only the problems in quality as previously discussed are brought about, but also an increase in cost tends to be caused because of an increase in the amount of recycling into the kneading step.

The toner production steps as shown in FIG. 3 correspond to those of the production process disclosed in the Japanese Patent Application Laid-Open No. 53-58244. The process shown in FIG. 3 can achieve more effective removal of the fine particles of not larger than 2 to 3μ or less as compared to the process shown in FIG. 2. However, as previously discussed, the removal of the fine particles of not larger than 2 to 3μ is still unsatisfactory. In addition, the fine powder in which silica is included is difficult to be recycled which causes an increase in cost of toners.

SUMMARY OF THE INVENTION

An object of the present invention is to provide a process for producing a toner for developing an electrostatic image, which has solved the above problems.

Another object of the present invention is to provide a process for producing a toner for developing an electrostatic image, which can achieve a successful removal of the fine powder.

Still another object of the present invention is to provide a process for producing a toner for developing an electrostatic image, the particle surfaces of which a fine silica powder has been imparted to in a good state.

A further object of the present invention is to provide a process for producing a toner for developing an electrostatic image, which can achieve a good economical efficiency.

The above objects of the present invention can be achieved by a process for producing a toner for developing an electrostatic image, comprising;

a first classification step for classifying a colored resin powder containing at least a resin and a coloring agent to remove fine powder to give a classified powder having a given particle size distribution;

a mixing step for mixing the classified powder with a fine silica powder to give a mixed powder; and a second classification step for removing the fine powder from the mixed powder.

DESCRIPTION OF THE PREFERRED EMBODIMENTS

In the production process of the present invention, first classification and second classification are carried out. In the first classification, fine powder with a particle diameter smaller than a given size is removed from a powder material to be made into a toner in a classification step and coarse powder with a particle diameter larger than a given size is optionally removed so that the powder is controlled to have the desired particle size. As a result of this first classification, the greater part of the fine powder included in the material powder can be removed. After the first classification, the following steps are taken in order to remove the fine powder having been not completely removed. First, a fine silica powder is added to the material powder optionally together with other additives and the resulting material powder is dispersed and mixed using a mixer having a sufficient dispersion power. Thereafter, the second classification is carried out so that fine powder removed in the second classification as the fine powder may be approximately in an amount of from 0.5 to 15% by weight.

Figure 1:
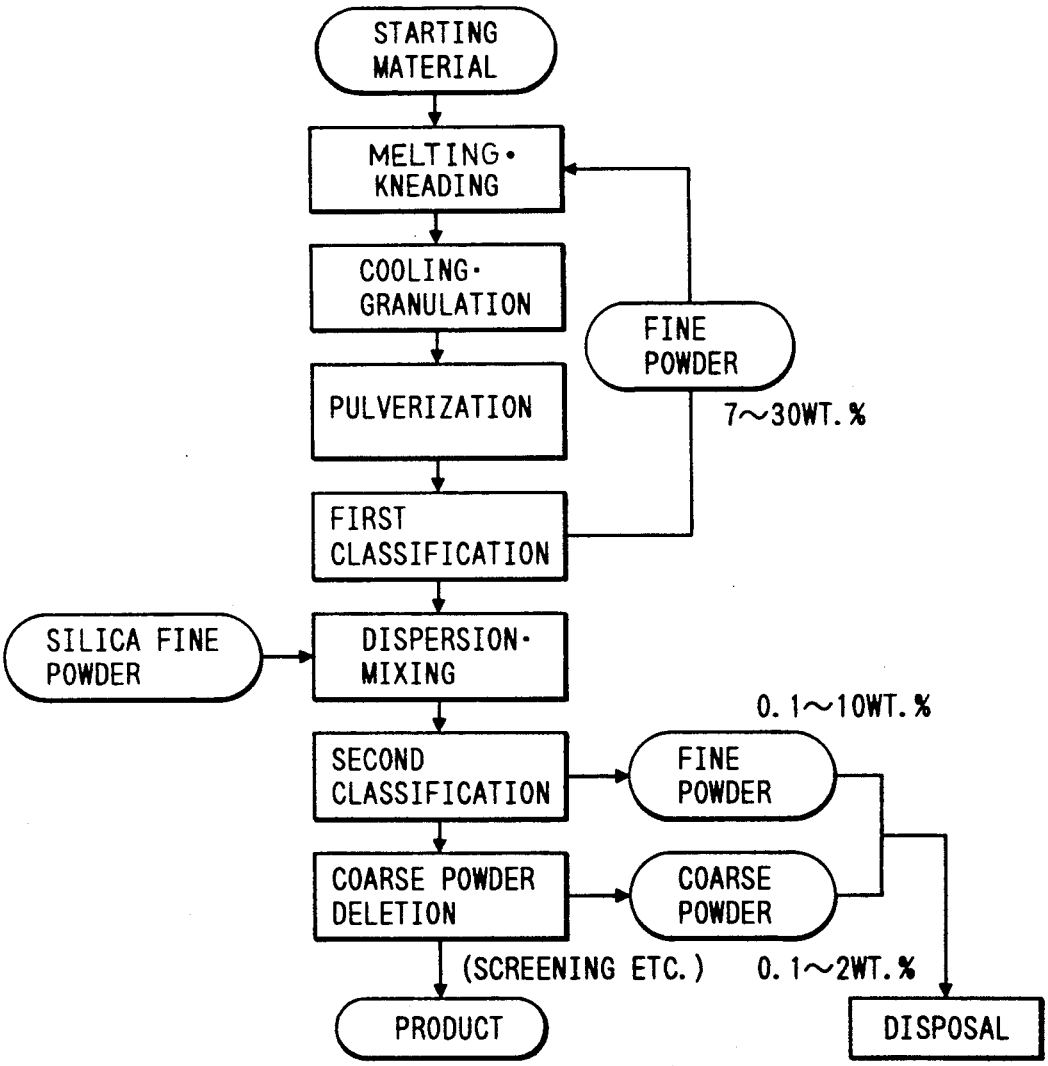
FIG. 1 is a flow chart to show the steps and material flow in the production process of the present invention.

FIG. 1 shows a flow chart of the above process. The greater part of the fine powder is removed in the first classification, after which the material from the first classification is thoroughly dispersed in the presence of fine silica powder. The procedure eliminates the problem where fine particles of from 2 to 3μ in diameter firmly adhere to the toner particles of the desired particle size. By removing the fine powder in the second classification, any particles of diameter 2 to 3μ that were not completely removed in the first classification, as well as any fine silica particles not adhered to toner particles, can be removed efficiently.

In the present invention, the process may preferably comprise the steps of cooling, crushing and pulverizing a melt-kneaded product containing at least a binder resin and a coloring then controlling the first classification step on the pulverized product to yield a desired particle size, thereafter adding a fine silica powder to the classified powder optionally together with other additives to carry out dispersion and mixing, and then preferably carry out second classification at a finer particle size cut off than that in the first classification step. The process of the present invention also can be carried out when the steps of melt-kneading and pulverizing in the process for producing a toner are replaced with spray drying or other means.

In the present invention, classification conditions may preferably be set in such a manner that in the first classification the fine powder is removed in an amount of from 7 to 30% by weight, and preferably from 10 to 25% by weight, based on the feed of the material powder, and in the second classification the fine powder is removed in an amount of from 0.5 to 15% by weight, preferably from 1 to 5% by weight, and more preferably from 1 to 3% by weight. In view of the production efficiency of toners and the cost of toners, it is more preferred that the amount of the fine powder removed in the second classification be controlled so that not more than ½ (in weight ratio) of the amount of the fine powder removed in the first classification.

Even if conditions are set in the first classification so that the fine powder is removed in an amount of more than 30% by weight, the content of the fine powder with a particle diameter of from 2 to 3μ will be significantly decreased. In addition, there is the possibility that the return of the fine powder to the melt-kneading step increases to bring about ill effects of not only a cost increase but also a broader particle size distribution.

On the other hand, if the amount of fine powder removed in the first classification is less than 7% by weight, the proportion of particles with a particle diameter of from 3 to 6μ increases in the powder obtained from the first classification and this makes it necessary to increase the amount of the fine powder to be removed in the second classification, resulting in an increase in the fine powder to be discarded. This is undesirable from an economical viewpoint.

In the first classification, a usual classifier may be used which is used in the preparation of toners. In the second classification, however, it is preferred in order to satisfy the above conditions to use a classifier having a very fine cut size, which is as fine as from about 1 to 4μ in particle diameter. Such classifiers include the T-Plex Ultrafine Separator (trade name), manufactured by Alpine Co.; Turboclassifier (trade name), manufactured by Nisshin Engineering Co.; Micron Separator (trade name), manufactured by Hosokawa Micron Co.; having a high-speed classifying blade. Examples of classifiers without a rotating blade are the cyclone type classifier manufactured by Ishikawajima-Harima Heavy Industries Co., Ltd. (IHI), a DS separator (a special type) manufactured by Nippon Pneumatic Industries Co., and Elbow Jet Classifier manufactured by Nittetsu Kogyo K. K. The classifiers of the type having a rotating classifying blade must be operated at a very high rotational speed (from twice to ten times the rotational speed of that in the case when usual toner particles are classified). In view of the agglomerates produced at the bearings and the resulting heat generated, classifiers having no rotating blade are preferred in the second classification because they have long run stability, durable bearings and last well. In this instance, in order to regulate the amount of the fine silica powder (optionally with other additives) present in a toner product, it is required for the material powder to be sufficiently dispersed and for the fine silica powder to be adhered to the toner particles in order to substantially prevent agglomeration and resulting coarse particles. If the fine silica powder is insufficiently dispersed, the coarse particles formed of agglomerates of the fine silica powder may cause fog or white dots on a black solid area. Moreover, in the step of removing coarse powder by the use of a sieve, the agglomerates of the fine silica powder are removed together with the coarse powder, so that the amount of fine silica powder to be added may decrease to make unstable the amount of the fine silica powder present in a toner. If the fine silica powder is insufficiently dispersed and the fine silica powder is not well firmly adhered to the toner particles, the amount of the fine silica powder present may decrease at the time of classification and can not be stabilized. In consideration of the dispersion powder and the requirement that toner particles are not ground, it is preferred to disperse the fine silica powder by mixing at from 20 m/sec to 70 m/sec, and more preferably at from 25 m/sec to 60 m/sec (peripheral speed at the tip of the rotating blade.) A mixing time of from 0.1 to 60 minutes, and preferably from 1 to 30 minutes, is advantageous in view of efficiency.

Figure 4:
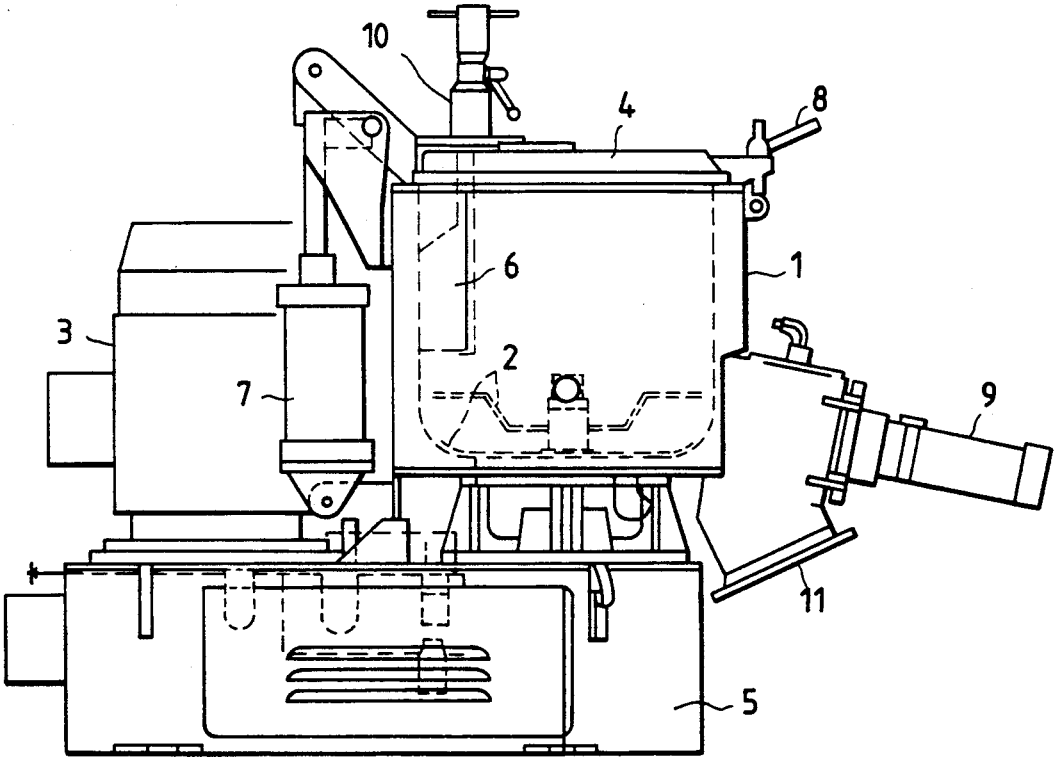
FIGS. 4 and 5 each schematically illustrates an example of an apparatus in which a fine silica powder and a toner material powder are added, dispersed and mixed.
Figure 5:
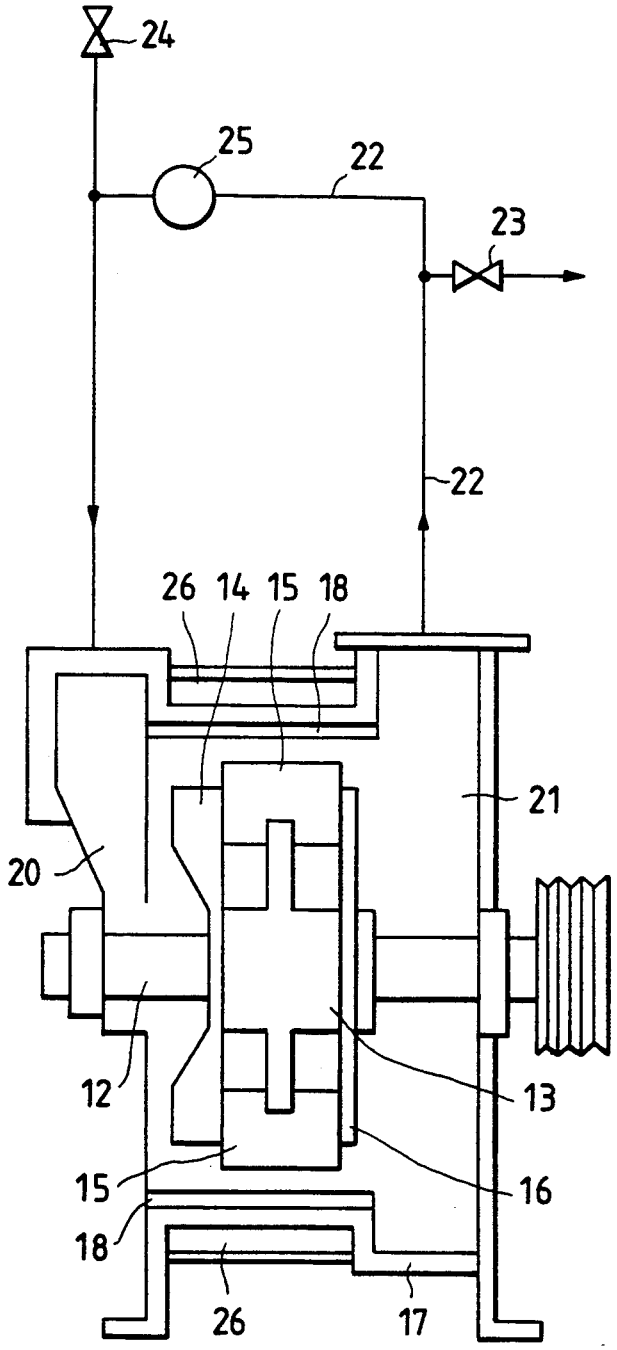

FIGS. 4 and 5 each illustrate an example of a mixer having a stirring blade.

The mixer shown in FIG. 4 comprises a jacket 1, a stirring blade 2, a motor 3, a cover 4, a base 5, a control board 6, a cylinder 7, a rock 8 for the cover, a cylinder 9, a direction control unit 10, and an outlet 11.

A specific example of the mixer shown in FIG. 4 includes a Henschel mixer.

The mixer shown in FIG. 5 comprises a rotating shaft 12, a rotor 13, a dispersion blade 14, a rotating member (blade) 15, a partition disc plate 16, a casing 17, a liner 18, an impact zone 19, an inlet chamber 20, an outlet chamber 21, a return path 22, a product take-off valve 23, a material feed valve 24, a blower 25, and a jacket 26.

In the production process of the present invention, good results can be obtained when the fine silica powder is added preferably in an amount of from 0.1 to 3% by weight, and more preferably from 0.2 to 2% by weight, based on the weight of the first classified powder or the toner. Addition of an excessive amount of silica powder may result in not only a decreasing of toner image density or humidity characteristics with regard to image quality but also create difficulties in mixing and dispersing in mixing and dispersion with regard to the process for producing a toner. It may also cause large quantities of fine silica powder to move into the fine powder which is removed in the classification. The process of the present invention, however, can enjoy a greater latitude than the conventional process when the fine silica powder is added in the excessive amount, showing the tendency that its ill effect is decreased.

In the present invention, the particle size distribution is measured in the following way: Coulter Counter TA-II Type (manufactured by Coulter Electronics Inc.) or Elzone Particle Counter 80XH-2 (Particle Data Co., U.S.A) is used as a measuring apparatus, and the number average distribution and volume average distribution are outputted. As an electrolytic solution, an aqueous solution of 1–4% NaCl is used.

As a measuring method, 0.1 to 5 ml of a surface active agent (preferably an alkylbenzene sulfonate) is added as a dispersant to 100 to 150 ml of the aqueous electrolytic solution, and 0.5 to 50 mg of the sample to be measured is further added.

The electrolytic solution in which a sample has been suspended is put in an ultrasonic dispersing machine, and dispersion treatment is carried out for about 1 to 3 minutes. Particle size distribution of the particles of 1 to 40μ is measured with the above Coulter Counter TA-II Type, using a 12 to 120μ aperture, to determine the volume average distribution and number average distribution.

As a method of measuring particle diameter of not more than 3μ, the Coulter counter results may show poor reproducibly due to noise. Consequently, to check the Coulter counter results, particles are placed under a microscope and with changes in the depth of focus on the same plane, the particles are photographed. The data are analyzed to determine the number distribution. In this instance, particles with diameters of from 0.6 to 20μ are analyzed and those of less than 0.6μ are deleted from analysis on account of the influence of the fine silica powder. When the microscope is used, particle diameters of about 3,000 particles are measured to determine the distribution.

In the present invention, the binder resin in the toner includes, for example, homopolymers of styrene and derivatives thereof, such as polystyrene, poly-p-chlorostyrene, and polyvinyltoluene; styrene copolymers such as a styrene/p-chlorostyrene copolymer, a styrene/propylene copolymer, a styrene/vinyltoluene copolymer, a styrene/vinylnaphthalene copolymer, a styrene/methyl acrylate copolymer, a styrene/ethyl acrylate copolymer, a styrene/butyl acrylate copolymer, a styrene/octyl acrylate copolymer, a styrene/methyl methacrylate copolymer, a styrene/ethyl methacrylate copolymer, a styrene/butyl methacrylate copolymer, a styrene/methyl α-chloro methacrylate copolymer, a styrene/acrylonitrile copolymer, a styrene/vinyl methyl ether copolymer, a styrene/ethyl vinyl ether copolymer, a styrene/methyl vinyl ketone copolymer, a styrene/butadiene copolymer, a styrene/isoprene copolymer, and a styrene/acrylonitrile/indene copolymer; polyvinyl chloride, polyvinyl acetate, polyethylene, polypropylene, silicone resins, polyesters, epoxy resins, polyvinyl butyral, rosins, modified rosins, terpene resins, phenol resins, xylene resins, aliphatic or alicyclic hydrocarbon resins, aromatic petroleum resins, chlorinated paraffins, and paraffin wax. These may by used alone or in the form of a mixture.

Of these resins, styrene/acrylate copolymers can be preferably used in the present invention. Particularly preferably used are a styrene/n-butyl acrylate (St-nBA) copolymer, a styrene/n-butyl methacrylate (St-nBMA) copolymer and a styrene/n-butyl acrylate/2-ethylhexyl methacrylate (St-nBA-2EHMA) copolymer.

As the coloring agent that can be added to the toner according to the present invention, carbon black, copper phthalocyanine, and black iron oxide can be used which are conventionally known in the art.

When the toner is magnetic toner, materials capable of being magnetized when placed in a magnetic field are used as magnetic fine particles contained in the magnetic toner. They include powders of ferromagnetic metals such as iron, cobalt and nickel, or alloys or compounds such as magnetite, $\gamma$-$Fe_2O_3$ and ferrite.

These magnetic fine particles may preferably have a BET specific surface area, as measured by nitrogen adsorption, of from 2 to 20 $m^2/g$, and particularly from 2.5 to 12 $m^2/g$. Magnetic powder with a Mohs hardness of from 5 to 7 is preferred. This magnetic powder should be contained in an amount of from 10 to 70% by weight based on the amount of toner.

The toner of the present invention may optionally contain a charge controlling agent. Usable negative charge controlling agents are metal complex salts of monoazo dyes, and metal complex salts of salicylic acid, an alkyl saliyclic acid, a dialkyl salicylic acid or naphthoic acid.

The toner according to the present invention may preferably be an insulating toner having a volume specific resistivity of not less than $10^{10}$ Ω.cm, and particularly not less than $10^{12}$ Ω.cm.

The fine silica powder used in the present invention may preferably have a particle diameter of from 0.005 to 0.2μ.

The fine silia powder used in the present invention includes a fine silica powder produced by vapor phase oxidation of a silicon halide, and a fine silica powder prepared by the wet process. It may further include powders obtained by subjecting any of these fine silica powders to a treatment such as a silicone oil treatment, an amino-modified silicone oil treatment, or a treatment with a silane coupling agent.

The fine silica powder produced by vapor phase oxidation of a silicon halide refers to those called the dry process silica or the fumed silica. The vapor phase oxidation of a silicon halide is a process that utilizes a heat decomposition oxidation reaction in the oxyhydrogen flame of silicon tetrachloride gas. The reaction basically proceeds as follows.

$$SiCl_4+2H_2+O_2 \rightarrow SiO_2+4HCl$$

In this preparation step, it is also possible to use a metal halide such as an aluminum halide or a titanium chloride together with the a silicon halide to give a composite fine powder of silica and metal oxide. The present invention includes fine silica powders derived from the processes described above.

Commercially available fine silica powders used in the present invention, produced by the vapor phase oxidation of the silicon halide, include, for example, those which are on the market under the following trade names:

Aerosil 130, 200, 300, 380, OX50, TT600, MOX80, MOX170, COK84 (Aerosil Japan, Ltd.);

Ca-O-SiL M-5, MS-7, MS-75, HS-5, EH-5 (CABOT CO.);

Wacker HDK N 20, V15, N20E, T30, T40 (WACKER-CHEMIE GMBH);

D-C Fine Silica (Dow-Corning Corp.); and

Fransol (Franzil Co.).

As the wet process preparation method for the fine silica powder used in the present invention, various conventionally known methods can be applied. For example, they include a method of formation by the decomposition of sodium silicate in the presence of an acid, a reaction scheme of which is shown below.

$$Na_2O.XSiO_2+HCl+H2O \rightarrow SiO_2.nH_2O+NaCl$$

In addition, the wet process also includes the decomposition of sodium silicate in the presence of ammonium salts or alkali salts, a method in which an alkaline earth metal silicate is produced from sodium silicate, followed by decomposition in the presence of an acid to form silicic acid, a method in which a sodium silicate solution is formed into silicic acid through an ion-exchange resin, and a method in which naturally occurring silicic acid or silicate is utilized.

In the fine silica powder herein mentioned, it is possible to apply anhydrous silicon dioxide (silica), as well as silicates such as aluminum silicate, sodium silicate, potassium silicate, magnesium silicate, and zinc silicate.

A silica powder obtained by heat treatment of any of these silica powders at a temperature of not lower than 400° C. is the fine silica powder used in the present invention. The heat treatment may be carried out, for example, by putting the fine silica powder synthesized by the wet process in an electric furnace and allowing it to stand at a temperature not lower than 400° C. for a suitable period of time (for example, for 10 minutes to 10 hours). There are no particular limitations on the heat treatment so long as the properties of toners are not seriously lowered.

In the present invention, a developer containing the fine silica powder synthesized by the wet process, having been subjected to heat treatment at a temperature of not lowre than 400° C., gives a stable and uniform amount of triboelectricity between toner particles, between a toner and a carrier, or between a toner and a toner support such as a sleeve in the case of a one-component developer. It is also free from fog, toner black spots around line images and toner agglomeration, and is durable, producing a large number of copies. The toner is capable of reproducing a stable image despite changes in temperature and humidity, in particular, a toner than can achieve a great transfer efficiency even under conditions of extremely high temperature and high humidity. In addition, it is a developer that may cause only a very small decrease in the amount of triboelectricity and also little cause a lowering of the quality of reproductions even if it is stored under conditions of high temperature and high humidity for a long period of time.

The wet process silicas include, for example, the following ommercially available products.

| | |
|---|---|
| Nipsil | Nippon Silica Industrial Co., Ltd. |
| Tokusil, Finesil | Tokuyama Soda Co., Ltd. |
| Vitasil | Taki Seihi Co. |
| Silton, Silnex | Mizusawa Industrial Chemicals, Ltd. |
| Starsil | Kamishima Kagaku Co. |
| Himezil | Ehime Yakuhin Co. |
| Sairoid | Fuji-Davison Chemical Ltd. |
| Hil-Sil | Pittsburgh Plate Glass Co. |
| Durosil | Fiillstoff-Gesellschaft Marquart |
| Ultrasil | Fiillstoff-Gesellschaft Marquart |
| Manosil | Hardman and Holden |
| Hoesch | Chemische Fabrik Hoesch K-G |
| Sil-Stone | Stone Rubber Co. |
| Nalco | Nalco Chemical Co. |
| Quso | Philadelphia Quaetz Co. |
| Imsil | Illinis Minerals Co. |
| Calcium Silikat | Chemische Fabrik Hoesh K-G |
| Calsil | Füllstoff-Gesellschaft Marquart |
| Fortafil | Imperial Chemical Industries, Ltd. |
| Microcal | Joseph Crosfield & Sons, Ltd. |
| Manosil | Hardman and Holden |
| Vulkasil | Farbenfabiken Bryer, A.-G. |
| Tufknit | Durham Chemicals, Ltd. |
| Silmos | Shiraishi kogyo, Ltd. |
| Starlex | Kamishima Kagaku co. |
| Fricosil | Taki Seihi Co. |

In the present invention, it is preferred to use a hydrophobic silica treated with a silane coupling agent or a silicone oil. The preferred hydrophobic fine silica powder has a hydrophobicity in the range of from 30 to 80 as measured by ethanol titration. The hydrophobic fine silica can be made using conventional methods, by chemical treatment with an organic silicon compound capable that is capable either of physical adsorption or, or reacting with, the silica. A preferred method requires treating the fine silica powder from vapor phase oxidized silicon halide with an organic silicon compound and a silane coupling agent. Alternatively, the organic silicon compound and coupling agent can be reacted together before treatment with the fine silica powder.

The silane coupling agent or the organic silicon compound includes hexamethyldisilazane, trimethylsilane, timethylchlorosilane, timethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, p-chloroethyltrichlorosilane, chloromethyldimethylchlorosilane, triorganosilyl mercaptan, trimethylsilyl mercaptan, triorganosilyl acrylate, vinyldimethylacetoxysilane, dimethylethoxysilane, dimethyldimethoxysilane, diphenyldiethoxysilane, hexamethyldisiloxane, 1,3-divinyltetramethyldisiloxane, 1,3-diphenyltetramethyldisiloxane, and a dimethylpolysiloxane having 2 to 12 siloxane units per molecule and containing a hydroxyl group bonded to each Si in the units positioned at the terminals. These may be used alone or in the form of a mixture of two or more kinds.

The silicone oil used when the fine silica powder is treated with a silicone oil commonly refers to a silicone oil represented by the following formula:

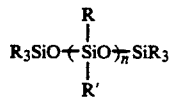

A silicone oil with a viscosity of from about 5 to 5,000 cSt. at 25° C. is used as a preferred silicone oil. For example, preferred are methylsilicone oil, dimethylsilicone oil, phenylmethylsilicone oil, chlorophenylmethylsilicone oil, an alkyl-modified silicone oil, a fatty acid-modified silicone oil, and a polyoxyalkylene-modified silicone oil. These may be used alone or in the form of a mixture of two or more kinds.

As a preferred method for the silicone oil treatment, the fine silica powder produced by vapor phase oxidation of a silicon halide is treated with the silicone oil after it has been treated with the silane coupling agent previously described or at the same time when it is treated with the silane coupling agent. For example, the fine silica powder and the silicone oil may be directly mixed using a mixer such as a Henschel mixer, or may be treated by spraying the silicone oil to the fine silica powder. After the silicone oil has been dissolved or dispersed in a suitable solvent, the fine silica powder may be mixed therein, followed by removal of the solvent to obtain the desired product.

The fine silica powder used in the present invention is treated with both treating agents, i.e., the silane coupling agent and silicone oil previously described. Hence, when it is incorporated in a developer, the developer can have a stable and large amount of triboelectricity and also a sharp and uniform distribution of the amount of triboelectricity. The silane coupling agent and silicone oil used for the treatment of the fine silica powder may preferably be used in a weight ratio of 15:85 to 85:15. This ratio may be varied, whereby the value of the amount of triboelectricity of the developer containing the fine silica powder can be controlled to the desired value. This ratio can be arbitrarily selected.

The total of the silane coupling agent and silicone oil preferably may be in an amount of from 0.1 to 30% by weight, and more preferably from 0.2 to 20% by weight, based on the fine silica powder.

In the present invention, a silicone oil having an amine on its side chain can be used as a treatment for the fine silica powder so that a positively chargeable hydrophilic fine silica powder can be obtained.

Such an amino-modified silicone oil includes, for example, the following:

| Trade name | Viscosity at 25° C. (cps) | Amine equivalent |
|---|---|---|
| SF8417 (Toray Silicone Co., Ltd.) | 1,200 | 3,500 |
| KF393 (Shin-Etsu Chemical Co., Ltd.) | 60 | 360 |
| KF857 (Shin-Etsu Chemical Co., Ltd.) | 70 | 830 |
| KF859 (Shin-Etsu Chemical Co., Ltd.) | 60 | 22,500 |
| KF860 (Shin-Etsu Chemical Co., Ltd.) | 250 | 7,600 |
| KF861 (Shin-Etsu Chemical Co., Ltd.) | 3,500 | 2,000 |
| KF862 (Shin-Etsu Chemical Co., Ltd.) | 750 | 1,900 |
| KF864 (Shin-Etsu Chemical Co., Ltd.) | 1,700 | 3,800 |
| KF865 (Shin-Etsu Chemical Co., Ltd.) | 90 | 4,400 |
| KF869 (Shin-Etsu Chemical Co., Ltd.) | 20 | 320 |
| KF383 (Shin-Etsu Chemical Co., Ltd.) | 20 | 320 |
| X-22-3680 (Shin-Etsu Chemical Co., Ltd.) | 90 | 8,800 |
| X-22-380D (Shin-Etsu Chemical Co., Ltd.) | 2,300 | 3,800 |
| X-22-3801C (Shin-Etsu Chemical Co., Ltd.) | 3,500 | 3,800 |
| X-22-3810B (shin-Etsu Chemical Co., Ltd.) | 1,300 | 1,700 |

The fine silica powder, preferably a hydrophobic colloidal fine silica powder, may preferably have a BET specific surface area of from 40 to 400, and preferably from 70 to 300, in view of its dispersion and mixing with classified powder and also in view of its adhesion to toner particles.

In the present invention, a different material may be added for the purpose of improving the properties of a toner together with the fine silica powder. Examples of such a material are particles having an abrasive action, lubricating fine powder, and so forth.

The particles having an abrasive action refer to an inorganic metal oxide, nitride, carbide, or metallic sulfate or carbonate having a Mohs hardness of not less than 3, which can be used alone or in combination. A nonexclusive list of examples are outlined below.

They include metal oxides such as $SrTiO_3$, $CeO_2$, CrO, $Al_2O_3$ and MgO, nitrides such as $Si_3N_4$, carbides such as SiC, and metallic sulfates or carbonates such as $CaSO_4$, $BaSO_4$, $CaCO_3$.

They preferably include $SiTiO_3$, $CeO_2$ (as exemplified by powders comprising $CeO_2$ and a rare earth element such as Milek, Milek T and ROX M-1), $Si_3N_4$ and SiC having a Mohs hardness of not less than 5.

These materials may be those having been subjected to surface treatment with a silane coupling agent, a titanium coupling agent, a zircoaluminate coupling agent, a silicone oil or other organic compound.

The preferred lubricating fine powder used includes particles of fluorinated polymers as exemplified by a tetrafluoroethylene resin (such as Teflon), polyvinylidene fluoride and carbon fluoride; and particles of fatty acid metal salts such as stearic acid zinc particles.

These lubricating fine powders may preferably have an average particle diameter of not more than 6μ, and more preferably not more than 5μ.

The addition of abrasive particles, lubricating powder or the like prevents film formation resulting from paper powder or toner fine powder on a photosensitive member and facilitates a better image which is stable with time.

The present invention will be described below in greater detail by giving Examples. In the following, "part(s)" refers to "part(s) by weight".

EXAMPLE 1

Following the flow chart as shown in FIG. 1, a toner was prepared as follows:

| | |
|---|---|
| Chromium complex of di-t-butylsalicylic acid (a negative charge controlling agent) | 4 parts |
| Styrene/2-ethylhexyl acrylate/divinylbenzene copolymer (copolymerization ratio: 80:20:1; a binder resin; weight average molecular weight: about 300,000) | 90 parts |
| Polyethylene wax (Hi-wax 200p, a product of Mitsui Petrochemical Company Limited) | 4 parts |
| Magnetic material (specific surface area: 8 $m^2/g$; a coloring agent) | 60 parts |

The above materials were heat-kneaded using a roll mill (150° C.) for about 30 minutes. The resulting kneaded product was cooled and thereafter granulated. The granulated product was subsequently pulverized using a pulverizer to have a volume average particle diameter of about 10 μm. A pulverized product was thus prepared. The pulverized product thus prepared was put in a zig-zag classifier manufactured by Alpine Co., in which the cut size was set so that particles with a particle diameter of not more than 5μ were decreased, and then fine powder was removed so that the classified powder had a volume average particle diameter of about 10.8μ. The fine powder removed at this stage was in an amount of 18% by weight. The classified powder had negatively chargeable properties.

To 100 parts by weight of the classified powder (toner particles) obtained after the above first classification, 0.5 part by weight of a negatively chargeable hydrophobic colloidal fine silica powder (R972, a product of Nippon Aerosil Co., Ltd.) was added, and then the classified powder and the fine silica powder were mixed and dispersed for 5 minutes using the mixer as shown in FIG. 4 (a Henschel mixer with a capacity of 75 l), at a peripheral speed of 40 m/sec at the tip of the stirring blade.

The classified powder mixed with the negatively chargeable hydrophobic colloidal fine silica powder was put in Elbow Jet Classifier (manufactured by Nittetsu Kogyo K.K.) in which the cut size was set so that particles with a particle diameter of not more than 3μ were decreased, and thus, fine powder was removed in an amount of 2% by weight to obtain a second classified powder having a volume average particle diameter of about 11.4μ. The second classified powder was passed through a 100 mesh sieve, and the powder having passed through the sieve of 100 meshes was used as a negatively chargeable magnetic toner for developing an electrostatic image.

On the sieve of 100 meshes, about 0.1% by weight of coarse powder remained.

Particle surfaces of the toner was observed with an electron microscope to confirm that the fine silica powder was adhered to the toner particle surfaces in a good state. In the toner having been passed through the second classification step, the fine silica powder was 0.49% by weight based on 100 parts by weight of the toner.

The above negatively chargeable magnetic toner was introduced in NP7050, manufactured by Canon Inc., to carry out development. As a result, a good image with an image density of 1.42 was obtained, with no fog on black spots around line images of letters or characters were observed. A 100,000 sheet durability test was also carried out. As a result, no substantial deterioration of images was seen, and also no lowering of the density at black solid areas in a copy because of the influence of white solid areas of the previous copy was seen. An image reproduction test was carried out after the toner was left standing for 2 weeks under conditions of high temperature (35° C.) and high humidity (90%). As a result, no increase in fog was seen.

EXAMPLE 2

A negatively chargeable magnetic toner was obtained in the same manner as in Example 1, except that in the first classification the fine powder was removed in an amount of 12% by weight to obtain a classified powder with a volume average particle diameter of 10.4μ and in the second classification the fine powder was removed in an amount of 13% by weight to prepare a second classified powder with a volume average particle diameter of 11.5μ.

The resulting negatively chargeable magnetic toner showed good development performance like that in Example 1.

In the toner of the present Example 2, however, the rate of utilization of the toner was inferior to that in Example 1.

COMPARATIVE EXAMPLE 1

Figure 2:
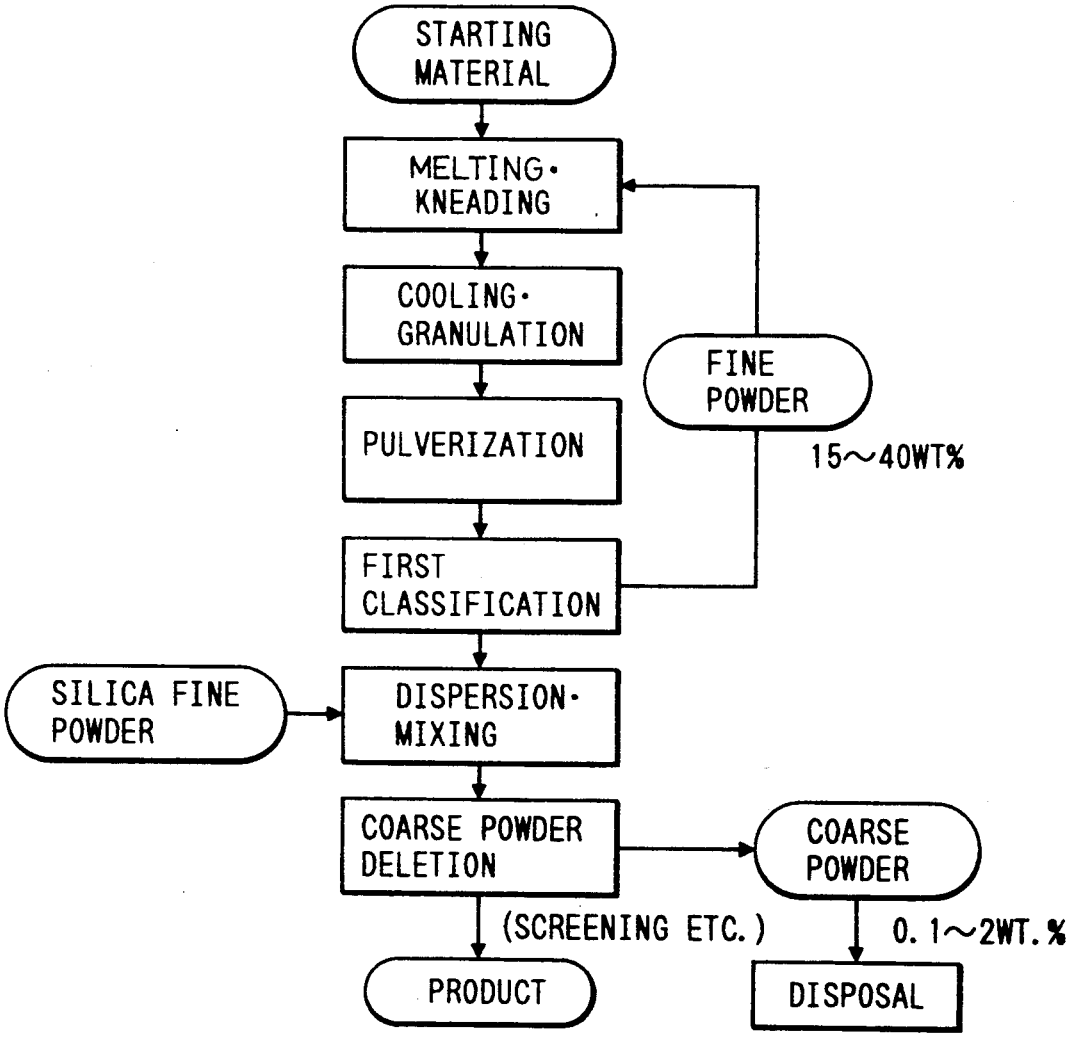
FIGS. 2 and 3 are flow charts to show the steps and material flow in the conventional processes.

Following the flow chart as shown in FIG. 2, a toner was prepared as follows:

| | |
|---|---|
| Chromium complex of di-t-butylsalicylic acid (a negative charge controlling agent) | 4 parts |
| Styrene/2-ethylhexyl acrylate/divinylbenzene copolymer (copolymerization ratio: 80:20:1; a binder resin; weight average molecular weight: about 300,000) | 90 parts |
| Polyethylene wax (Hi-wax 200p, a product of Mitsui Petrochemical Company Limited) | 4 parts |
| Magnetic material (specific surface area: 8 $m^2/g$; a coloring agent) | 60 parts |

The above materials were heat-kneaded using a roll mill (150° C.) for about 30 minutes. The resulting kneaded product was cooled and thereafter granulated. The granulated product was subsequently pulverized using a pulverizer to have a volume average particle diameter of about 10μ. A pulverized product was thus prepared. The pulverized product thus prepared was put in a zig-zag classifier manufactured by Alpine Co., in which the cut size was so set that particles with a particle diameter of not more than 5μ were decreased, and then fine powder was removed in an amount of 32% by weight so that the classified powder with a volume average particle diameter of about 11.7μ was prepared. To 100 parts by weight of the resulting classified powder, 0.5 part by weight of a negatively chargeable hydrophobic colloidal fine silica powder (R972, a product of Nippon Aerosil Co., Ltd.) was added, and then the classified powder and the fine silica powder were mixed and dispersed for 5 minutes using the mixer as shown in FIG. 4 (a Henschel mixer with a capacity of 75 l), at a peripheral speed of 40 m/sec at the tip of its stirring blade.

The mixed powder thus obtained was passed through a 100 mesh sieve, and the powder having passed through the 100 mesh sieve was used as a negatively chargeable magnetic toner for developing an electrostatic image.

On the 100 mesh sieve, about 2% by weight of coarse powder remained.

The negatively chargeable magnetic toner obtained in Comparative Example 1 was evaluated in the same manner as in Example 1. At the initial stage, a good image with an image density of 1.38 was obtained and the fog and the black spots around line images of letters or characters were in good states. A 100,000 sheet durability test was also carried out. As a result, the image density was lowered to 1.28. A lowering of image density was also seen occurring at black solid areas in a copy because of the influence of white solid areas of the previous copy. Here, the image density of 1.38 was lowered to 1.18. An image reproduction test was carried out after the toner was left standing for 2 weeks under conditions of high temperature (35° C.) and humidity (90%) of a temperature of 35° C. and a humidity of 90%. As a result, a little increase in fog was seen. On the part at which image density decreased, particles of 3μ or less in diameter adhered to the surface of the developing sleeve and were in a larger quantity than in Example 1.

COMPARATIVE EXAMPLE 2

Figure 3:
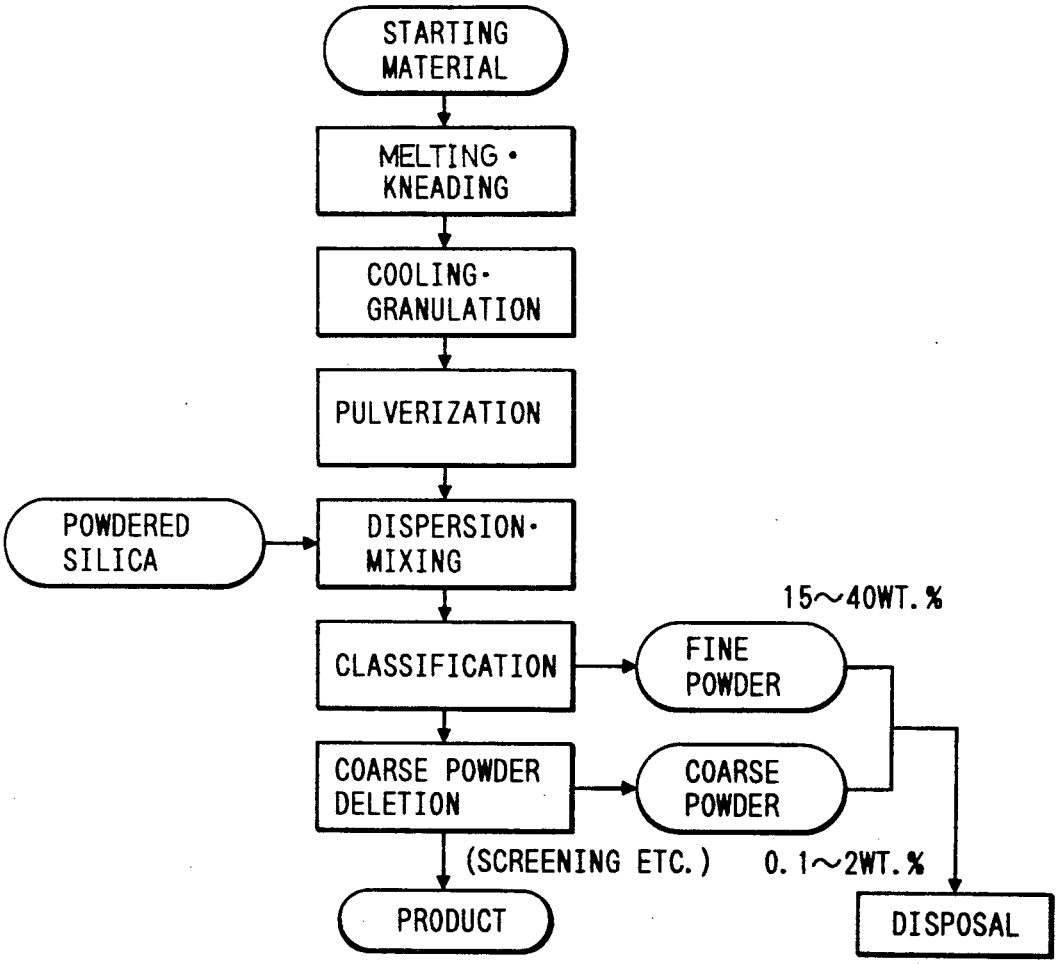

Following the flow chart as shown in FIG. 3, a toner was prepared as follows:

| | |
|---|---|
| Chromium complex of di-t-butylsalicylic acid (a negative charge controlling agent) | 4 parts |
| Styrene/2-ethylhexyl acrylate/divinylbenzene copolymer (copolymerization ratio: 80:20:1; a binder resin; weight average molecular weight: about 300,000) | 90 parts |
| Polyethylene wax (Hi-wax 200p, a product of Mitsui Petrochemical Company Limited) | 4 parts |
| Magnetic material (specific surface area: 8 $m^2/g$; a coloring agent) | 60 parts |

The above materials were heat-kneaded using a roll mill (150° C.) for about 30 minutes. The resulting kneaded product was cooled and thereafter granulated. The granulated product was subsequently pulverized using a pulverizer to have a volume average particle diameter of about 10μ. A pulverized product was thus prepared. To the resulting pulverized product with a volume average particle diameter of about 10μ, 0.5 part by weight of a negatively chargeable hydrophobic colloidal fine silica powder (R972, a product of Nippon Aerosil Co., Ltd.) was added, and these powders were mixed and dispersed for 5 minutes using the mixer as shown in FIG. 4, at a peripheral speed (40 m/sec) of its stirring blade.

The resulting mixed powder was put in a zig-zag classifier manufactured by Alpine Co., in which the cut size was set so that particles with a particle diameter of not more than 5μ were decreased, and thus fine powder was removed in an amount of 31% by weight to obtain a classified powder having a volume average particle diameter of 11.4μ. The classified mixed powder thus obtained was passed through a 100 mesh sieve, and the powder having passed through the 100 mesh sieve was used as a negatively chargeable magnetic toner for developing an electrostatic image.

On the 100 mesh sieve, about 0.1% by weight of coarse powder remained.

Since the hydrophobic fine silica powder was included in the 31% by weight of classified fine powder, it was difficult to recycle the fine powder, and this caused a great increase in cost in the production of the toner.

The negatively chargeable magnetic toner obtained in Comparative Example 2 was evaluated in the same manner as in Example 1. At the initial stage, a good image with an image density of 1.40 was obtained and the fog and the black spots around line images of letters or characters were seen only a little. As a result of a 100,000 sheet durability test, the image density of 1.40 was lowered to 1.33. In a 100,000 sheet durability test under conditions of a normal environment, a lowering of image density was also seen occurring at black solid areas in a copy because of the influence of white solid areas of the previous copy. Here, the image density of 1.40 at the initial stage was lowered a little to 1.34 after 100,000 sheet copying, showing that the toner of Example 1 was on a better in its performance.

An image reproduction test was carried out after the toner was left standing for 2 weeks under conditions of high temperature (35° C.) and high humidity of (90%). As a result, a little increase in fog was seen. In a durability test carried out after the toner was left standing for 2 weeks under conditions of high temperature and high humidity, the image density of 1.40 at the black solid areas was lowered to 1.25 because of the influence of white solid areas of the previous copy. Fine toner particles of 3μ or less in particle adhered in a larger quantity than in Example 1 and a smaller quantity than Comparative Example 1 on the developing sleeve corresponding to the part at which the lowering of image density occurred.

Data concerning the processes for producing toners according to Examples 1 and 2 and Comparative Examples 1 and 2 are shown in the following table.

TABLE

| | Volume average particle diameter | Amount of fine powder (Microscopic method) Particle diameter: 3μ to 0.6μ (number %) | Particle diameter: 1.8μ to 0.6μ (number %) | Material utilization rate |
|---|---|---|---|---|
| Example: | | | | |
| 1 | 11.4μ | 6.5 | 0.9 | 98% |
| 2 | 11.5μ | 6.1 | 0.8 | 87% |
| Comparative Example: | | | | |
| 1 | 11.7μ | 9.4 | 2.0 | 98% |
| 2 | 11.4μ | 8.8 | 1.6 | 69% |

EXAMPLE 3

Using a V-type mixer with a capacity of 100 l having no stirring blade, 100 parts by weight of the first classified powder with a volume average particle diameter of 10.8μ as prepared in Example 1 and 0.5 part by weight of a hydrophobic colloidal fine silica powder (R972) were mixed for 10 hours. A mixed powder obtained after mixing for 10 hours was classified using the Elbow Jet Classifier in the same manner as in Example 1 to give a second classified powder with a volume average particle diameter of 11.3μ. The second classified powder was passed through a 100 mesh sieve, and the powder having passed through the 100 mesh sieve was used as a negatively chargeable magnetic toner for developing an electrostatic image.

On the 100 mesh sieve, about 0.1% by weight of coarse powder and agglomerates of the fine silica powder remained.

In the resulting toner, the amount of fine silica powder was decreased to 0.4% by weight.

The toner of Example 3 was evaluated in the same manner as in Example 1. As a result, a good image with an image density of 1.35 was obtained at the initial stage, but the image density changed to 1.22 as a result of a 100,000 sheet durability test.

COMPARATIVE EXAMPLE 3

Using a V-type mixer with a capacity of 100 l having no stirring blade, 100 parts by weight of the first classified powder with a volume average particle diameter of 11.7μ as prepared in Example 1 and 0.5 part by weight of a hydrophobic colloidal fine silica powder (R972) were mixed for 10 hours. The resulting mixed powder was passed through a 100 mesh sieve, and the powder having passed through the 100 mesh sieve was used as a negatively chargeable magnetic toner for developing an electrostatic image.

On the 100 mesh sieve, about 0.2% by weight of coarse powder and agglomerates of the fine silica powder remained.

The toner of Comparative Example 3 was evaluated in the same manner as in Example 1. As a result, a good image with an image density of 1.25 was obtained at the initial stage, but the image density changed to 1.0 as a result of a 100,000 sheet durability test and more fog appeared than the case of Example 3.

EXAMPLE 4

Following the flow chart as shown in FIG. 1, a toner was prepared as follows:

| | |
|---|---|
| Nigrosine (a positive charge controlling agent) | 2 parts |
| Styrene/2-ethylhexyl acrylate/divinylbenzene copolymer (copolymerization ratio: 80:20:1; a binder resin; weight average molecular weight: about 300,000) | 90 parts |
| Polyethylene wax (Hi-wax 200p, a product of Mitsui Petrochemical Company Limited) | 4 parts |
| Magnetic material (specific surface area: 8 $m^2/g$; a coloring agent) | 60 parts |

The above materials were heat-kneaded using a roll mill (150° C.) for about 30 minutes. The resulting kneaded product was cooled and thereafter pulverized using a pulverizer to have a volume average particle diameter of about 10μ. A pulverized product was thus prepared. The pulverized product was put in a zig-zag classifier manufactured by Alpine Co., and fine powder was cut off so that the classified powder had a volume average particle diameter of about 10.8μ. The fine powder removed at this stage was in an amount of 15% by weight.

To 100 parts by weight of the resulting classified powder, 0.4 part by weight of a positively chargeable hydrophobic colloidal fine silica powder treated with an amino-modified silicone oil was added, and then these powders were mixed and dispersed for 5 minutes using the mixer as shown in FIG. 4, at a peripheral speed of 40 m/sec at the tip of its stirring blade. Thereafter, second classification was carried out using the Elbow Jet Classifier and fine powder was removed in an amount of 2% by weight to obtain a powder having a volume average particle diameter of about 11.4μ. The resulting powder was passed through a sieve of 100 meshes, to give a toner product.

The above toner was introduced in NP7050, manufactured by Canon Inc., to carry out development. As a result, a good image with an image density of 1.35 was obtained without fog and with less black spots around line images of letters or characters. An image reproduction test was carried out after the toner was left standing for 2 weeks under conditions of high temperature (35° C.) and high humidity of (90%). As a result, no increase in fog was seen. In a 50,000 sheet durability test, substantially no lowering was seen in the image density.

COMPARATIVE EXAMPLE 4

Following the flow chart as shown in FIG. 2, a toner was prepared as follows:

In Example 4, classification of the first one only was carried out, and the fine powder was removed in an amount of 32% by weight to give a powder with a volume average particle diameter of 11.4μ. In the same manner as in Example 4, the positively chargeable hydrophobic colloidal fine silica powder was added, followed by dispersion and mixing, and the resulting mixed powder was sieved to give a toner product. The toner was evaluated in the same manner as in Example 4. As a result, the image density was lowered to 1.25 when copies were continuously taken on 50,000 sheets, and a little increase was seen in fog and black spots around line images of letters or characters.

EXAMPLE 5

Following the flow chart as shown in FIG. 1, a toner was prepared as follows:

| | |
|---|---|
| Chromium complex of di-t-butylsalicylic acid (a negative charge controlling agent) | 4 parts |
| Styrene/2-ethylhexyl acrylate/divinylbenzene copolymer (copolymerization ratio: 80:20:1; a binder resin; weight average molecular weight: about 300,000) | 90 parts |
| Polyethylene wax (Hi-wax 200p, a product of Mitsui Petrochemical Company Limited) | 4 parts |
| Carbon Black | 10 parts |

The above materials were heat-kneaded using a roll mill (150° C.) for about 30 minutes. The resulting kneaded product was cooled and thereafter pulverized using a pulverizer to have a volume average particle diameter of about 10μ. A pulverized product was thus prepared. The pulverized product was put in a zig-zag classifier manufactured by Alpine Co., and fine powder was cut off so that the classified powder had a volume average particle diameter of about 11.0μ. The fine powder removed at this stage was in an amount of 17% by weight.

To 100 parts by weight of the resulting classified powder, 0.3 part by weight of a negatively chargeable hydrophobic colloidal fine silica powder (R972, a product of Nippon Aerosil Co., Ltd.) was added, and then these powders were mixed and dispersed for 5 minutes using the mixer as shown in FIG. 4, at a peripheral speed of 50 m/sec at the tip of its stirring blade. Thereafter, second classification was carried out using the Elbow Jet Classifier and fine powder was removed in an amount of 2% by weight to obtain a powder having a volume average particle diameter of about 11.5μ. The resulting powder was passed through a sieve of 100 meshes to remove agglomerates. A toner product was thus obtained.

The surfaces of 100 parts by weight of ferrite particles having a particle diameter between 250 and 300 mesh were coated with 0.8 part by weight of silicone resin to give magnetic particles. The above toner (10 parts by weight) and 100 parts by weight of the magnetic particles were mixed, and the mixed powder was introduced in a developing apparatus NP3525, manufactured by Canon Inc., to carry out development. As a result, a good toner image with an image density of 1.44 was obtained, a good fixability was achieved, and also a good offset resistance was obtained. Moreover, no fog was seen with less black spots around line images of letters or characters to give a good image.

When copies were continuously taken on 50,000 sheets, substantially no lowering was seen in the image density. The phenomenon that a fine toner is released from a carrier under conditions of a high humidity to contaminate the inside of a copying machine was remarkably decreased compared with conventional cases.

COMPARATIVE EXAMPLE 5

In Example 5, classification of the first one only was carried out, and the fine powder was removed in an amount of 32% by weight to give a powder controlled to have a volume average particle diameter of 11.6μ. To 100 parts by weight of the resulting toner particles, 0.5 part by weight of a hydrophobic colloidal fine silica powder (R972, a product of Nippon Aerosil Co., Ltd.) was added, and then these powders were mixed and dispersed. The resulting powder was passed through a sieve of 100 meshes to give a toner product. The toner was evaluated in the same manner as in Example 5. As a result, a good image with an image density of 1.38 was obtained, but a little increase in fog was seen under conditions of a low humidity. As a result of 50,000 sheet durability test, the image density was lowered to 1.25. In addition, the phenomenon that a fine toner is released from a carrier to contaminate the inside of a copying machine was a little seen under conditions of a high humidity.

As having been described above, the process for producing a toner of the present invention can efficiently and economically give a toner that can provide a high-quality image for a long period of time, and thus is very useful.

What is claimed:

1. A process for producing a toner for developing an electrostatic image, comprising:

a first classification step for classifying a colored resin powder containing at least a resin and a coloring agent to remove a first fine powder to provide a classified powder having a given particle size, wherein the fine powder removed in the first classification step is recycled as a material for the colored resin powder;

a mixing step for mixing the classified powder thus obtained and a fine silica powder to provide a mixed powder; and a second classification step for removing a second fine powder from said mixed powder.

2. The process according to claim 1, wherein said classified powder and said fine silica powder are mixed using a mixing means having a stirring blade.

3. The process to claim 2, wherein said classified powder and said fine silica powder are mixed under conditions of a peripheral speed of from 20 to 70 m/sec at the tip of the stirring blade.

4. The process according to claim 2, wherein said classified powder and said fine silica powder are mixed under conditions of a peripheral speed of from 25 to 60 m/sec at the tip of the stirring blade.

5. The process according to claim 1, wherein from 7 to 30% by weight of the fine powder is removed in the first classification step and from 0.5 to 15% by weight of the fine powder is removed in the second classification step.

6. The process according to claim 1, wherein from 10 to 25% by weight of the fine powder is removed in the first classification step and from 1 to 5% by weight of the fine powder is removed in the second classification step,

7. The process according to claim 6, wherein from 1 to 3% by weight of the fine powder is removed in the second classification step.

8. The process according to claim 1, wherein the amount of the fine powder removed in the second classification step is not more than 10% by weight of the amount of the colored resin powder classified in the first classification step.

9. The process according to claim 1, wherein the first classified powder is mixed with the fine silica powder added in an amount of from 0.1 to 3% by weight based on the first classified powder.

10. The process according to claim 1, wherein the first classified powder is mixed with the fine silica powder added in an amount of from 0.2 to 2% by weight based on the first classified powder.

11. The process according to claim 1, wherein the first classified powder and the fine silica powder are mixed for a period of time of from 0.1 to 60 minutes, using a mixing means having a stirring blade.

12. The process according to claim 11, wherein said mixing is a Henschel mixer.

13. The process according to claim 1, wherein the first classified powder and the fine silica powder are mixed for a period of time of from 1 to 30 minutes, using a mixing means having a stirring blade.

14. The process according to claim 1, wherein said mixing means is a Henschel mixer, and its stirring blade is rotated at a peripheral speed of from 20 to 70 m/sec.

15. The process according to claim 1, wherein the second classification step is carried out at a smaller cut size than the cut size in the first classification step.

16. The process according to claim 1, wherein said fine silica powder comprises a hydrophobic collodial fine silica powder.

* * * * *

UNITED STATES PATENT AND TRADEMARK OFFICE

CERTIFICATE OF CORRECTION

PATENT NO. : 5,147,753

DATED : September 15, 1992

INVENTOR(S) : NORIO HIKAKE

It is certified that error appears in the above-identified patent and that said Letters Patent is hereby corrected as shown below:

COLUMN 1

Line 14, "are" should read --are a--.
Line 16, "made" should read --member made--.
Line 38, "toner, which" should read --toner. The powders--.

COLUMN 2

Line 14, "can not" should read --cannot--.

COLUMN 3

Line 58, "carry" should read --to carry--.

COLUMN 4

Line 9, "powder" should read --powder is--.

COLUMN 5

Line 2, "can not" should read --cannot--.
Line 34, "create" should read --creating--.

COLUMN 7

Line 4, "silia" should read --silica--.
Line 47, "H2O" should read --$H_2O$--.

COLUMN 8

Line 8, "lowre" should read --lower--.
Line 36, "Fiillstoff" should read --Füllstoff--.

--

UNITED STATES PATENT AND TRADEMARK OFFICE

CERTIFICATE OF CORRECTION

PATENT NO. : 5,147,753

DATED : September 15, 1992

INVENTOR(S) : NORIO HIKAKE

It is certified that error appears in the above-identified patent and that said Letters Patent is hereby corrected as shown below:

COLUMN 8

Line 37, "Fiillstoff" should read --Füllstoff--.
Line 39, "Hoesch" should read --Hoechst-- (both occurrences)--.
Line 42, "Illinis" should read --Illinois--.
Line 43, "Hoesch" should read --Hoechst--.
Line 46, "Bryer" should read --Bayer--.
Line 48, "kogyo" should read --Kogyo--.
Line 49, "co." should read --Co.--.
Line 59, "that is capable" should be deleted and "or" should be deleted.
Line 68, "timethylchlorosilane, timethylethoxysilane," should read --trimethylchlorosilane, trimethylethoxysilane--.

COLUMN 10

Line 30, "shin" should read --Shin--.
Line 34, "400," should read --400 $m^2$,--.
Line 35, "300," should read --300 $m^2$,--.
Line 47, "are" should read --is--.
Line 53, "$SiTiO_3$," should read --$SrTiO_3$,--.

COLUMN 11

Line 29, "10 μm." should read --10 μ.--.

COLUMN 12

Line 6, "on" should read --or--.

--

UNITED STATES PATENT AND TRADEMARK OFFICE

CERTIFICATE OF CORRECTION

PATENT NO. : 5,147,753

DATED : September 15, 1992

INVENTOR(S) : NORIO HIKAKE

It is certified that error appears in the above-identified patent and that said Letters Patent is hereby corrected as shown below:

COLUMN 13

Line 25, "of a temperature of 35°C. and a humidity" should be deleted.
Line 26, "of 90%." should read --.--

COLUMN 14

Line 24, "on a" should be deleted.
Line 34, "particle" should read --diameter--.

COLUMN 16

Line 13, "of" should be deleted.

Signed and Sealed this

Second Day of November, 1993

Attest:

Bruce Lehman

BRUCE LEHMAN

Attesting Officer

Commissioner of Patents and Trademarks

--